US005282486A

United States Patent [19]

Hoover

[11] Patent Number: 5,282,486

[45] Date of Patent: Feb. 1, 1994

[54] CRUTCH WITH POWER LIFT AND FOOT AND METHOD OF USING SAME

[76] Inventor: L. Wayne Hoover, 7340 Patterson Halpin Rd., Sidney, Ohio 45365

[21] Appl. No.: 919,266

[22] Filed: Jul. 27, 1992

[51] Int. Cl.[5] ..... A61H 3/02

[52] U.S. Cl. ..... 135/69; 135/70; 135/75; 623/44

[58] Field of Search ..... 135/65, 66, 68, 69, 135/70, 75; 482/67; 623/40, 44, 53

[56] References Cited

U.S. PATENT DOCUMENTS

| | | | |
|---|---|---|---|
| 679,468 | 7/1901 | Pratt | 135/84 |
| 2,203,406 | 2/1941 | Johnson | 135/84 |
| 2,351,145 | 6/1944 | Pearson | 135/69 |
| 2,537,351 | 1/1951 | Johnson et al | 623/44 X |
| 2,667,644 | 2/1954 | Johnson | 623/44 X |
| 2,672,618 | 3/1954 | Haag | 623/44 |
| 3,157,188 | 11/1964 | Farnham | 135/69 |
| 3,157,189 | 11/1964 | Farnham | 135/69 |
| 3,416,546 | 12/1968 | Carpenter | 135/68 |
| 3,916,450 | 11/1975 | Minor | 623/44 X |
| 4,237,916 | 12/1980 | Harrison-Smith et al. | 135/69 |

FOREIGN PATENT DOCUMENTS 0867428 2/1953 Fed. Rep. of Germany ..... 623/40

*Primary Examiner*—Carl D. Friedman
*Assistant Examiner*—Lan M. Mai
*Attorney, Agent, or Firm*—Joseph G. Nauman

[57] ABSTRACT

A novel form of crutch is provided which can be used, particularly by paraplegics, to move between sitting and standing positions. The crutch includes a unique foot mechanism which gives added stability to the user of a pair of the crutches during such sitting/standing transitions, and which can be retracted so as to avoid interference with normal crutch-aided walking. A set of such powered crutches, incorporating both power extension/retraction and power foot adjustment, are capable of extended powered operation with on-board electrical power, and use power only for adjustment and are self-locking into adjusted positions. The power assist of the crutches are controllable from switches strategically located by the crutch handles so the user can manipulate the control switches without releasing his/her hold on the crutch handles. Also disclosed is a unique method of assisting disabled persons, using such crutches, to move between seated and standing positions without further assistance.

6 Claims, 10 Drawing Sheets

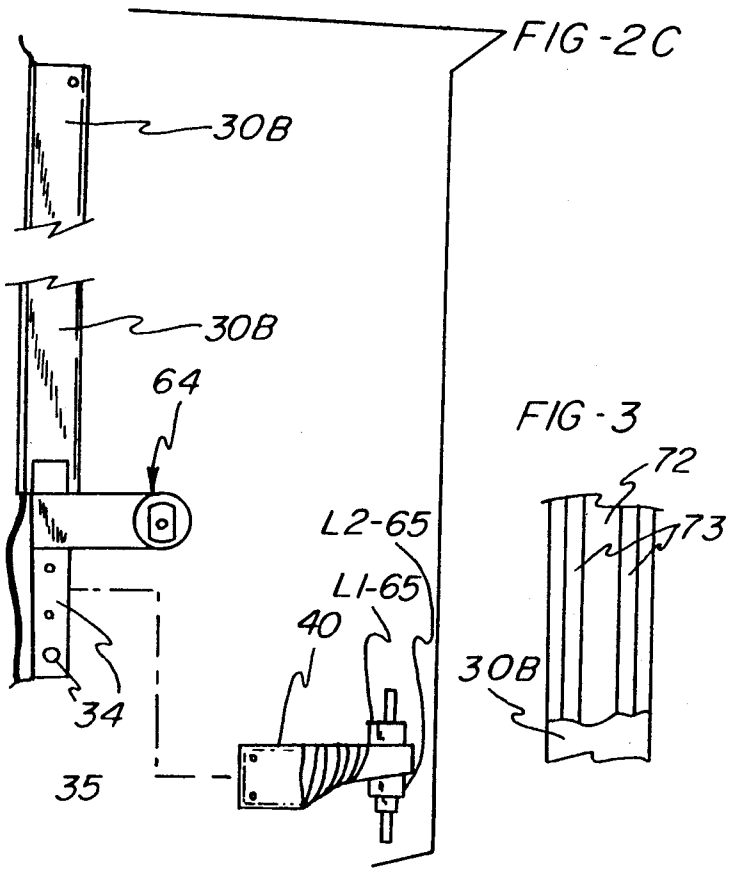
FIG-2C
FIG-3
72
73
30B
L2-65
L1-65
40
30B
30B
64
34
35
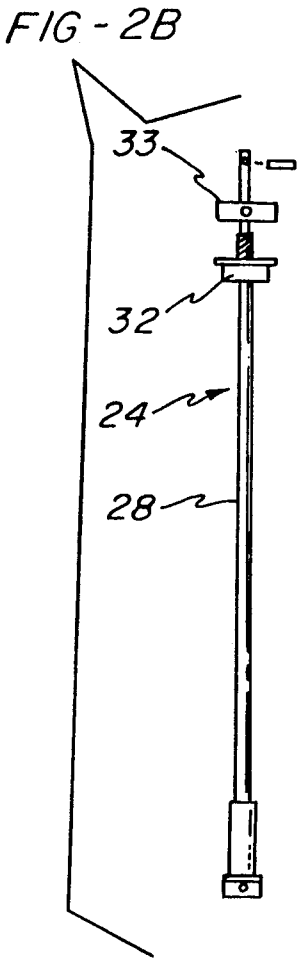
FIG-2B
33
32
24
28

CRUTCH WITH POWER LIFT AND FOOT AND METHOD OF USING SAME

FIELD OF THE INVENTION

This invention relates to power operated crutches, and particularly to a pair of user controlled power operated crutches, and a method of using such crutches which can effectively assist a paraplegic person, or a person of like disability, fitted with a full body brace, in transition between seated and standing position. The crutches can thereafter be used in conventional fashion to assist such person in walking.

BACKGROUND OF THE INVENTION

Power operated crutches having lengthwise extensible/retractable motion are known, and have been the subject of U.S. Pat. Nos. 3,157,188, 3,157,189, 3,416,546, and 4,237,916. All of those are fitted with conventional tips, generally in the form of an elastomeric cup fitted to the bottom of the crutch post and intended to provide a somewhat resilient minimized slip contact with the underlying floor, pavement, etc. Other patents disclose pivoting or conforming tips which may include a somewhat enlarged floor contact member to make an enlarged "footprint" contact and also provide limited 360° motion of the contact member with respect to the crutch tip, so as to maintain an extended area contact as the post is tilted during use of the crutch. Typical such patents are patent Nos. 2,230,406, and 679,468, as well as No. 2,351,145 which relates to stilts.

The prior art does not, however, address the need for a power operated crutch construction which can assist a handicapped person, particularly a paraplegic or similarly afflicted person, to rise from sitting to standing positions (and similarly to sit from a standing position) with additional assistance. Such persons, provided they have sufficient upper body strength, which many do have, can walk with crutches if they are fitted with a so-called full body brace. This is a generally available hinged metal (or equivalent) brace which has the capability of locking knee and hip joints in a straight line, so the person so fitted can stand on his/her legs without fear of collapsing, and can swing the lower torso between appropriate crutches and thus be self-ambulatory once achieving a standing position between the crutches.

By way of background explanation, such braces include a waist encircling upper part, which can be firmly attached to the wearer's torso above the hips, and linkages extending downward along the hips and legs. These linkages include joints at the location of the person's hip joints, which joints can be locked and unlocked, joints adjacent the person's knees, which also can be locked and unlocked, and lower supports which receive and attach to the calves, ankle joints and feet of the wearer. With the aforementioned joints unlocked, the various links pivot to allow movement of the person's legs to a seated position. With the links along the legs extended and locked, the persons legs are supported in an extended position. With the person standing erect, and the hip joints of the brace locked, the persons legs are supported in line with the upper torso.

Thus, there is a need for power operated crutches which have capability of assisting persons using such a brace in transition between seated and standing positions without additional help, thereby considerably enhancing such persons' mobility and self reliance.

SUMMARY OF THE INVENTION

The present invention provides a power crutch which, used in pairs, can lift or lower a person having a severe lower torso handicap and fitted with a full body brace, from a seated position with braced legs locked and fully extended, into a standing position between the crutches, and can assist the person in reversing that movement from standing to sitting. The crutches are preferably powered by self contained batteries and small electric motors operating lead-screw linear actuators (or equivalent). These actuators are 1) an operator controlled mechanism which extends and retracts the length of the crutch from armpit pad to tip, and 2) a further operator controlled mechanism which tilts a unique foot device pivotally connected to the lower tip region of the crutch. A small conventional electrical charger, preferably built-in, can be used to energize the batteries sufficiently to allow several hours of use, since power drain is only required during power assisted transition between seated and standing positions; at other times the crutches can function in conventional fashion without power consumption.

Small three-position center-biased-off switches are fitted to control reversible powered operation of the actuators from the region of the crutch handles, so the person can effectively control the extension/retraction of crutch length, and pivoted position of the foot, without moving his/her hands from gripping the crutch handles. This can be accomplished while the person is sensing and compensating for shifts in weight distribution, thus allowing a close control over any deviation toward and away from balanced positions.

The unique crutches provided by the invention each include a covered pocket or chamber in the region between the arm pit pad and the handle (usually a vertically elongated V-shape) having receptacle space for the batteries, an external connection for a small electrical charger, the upper end of a length extending/retracting lead-screw actuator and a connected small reversible DC motor, and the upper end of an extensible rod or tube having telescoping parts which form the lower leg portion of the crutch, and which contain the major length of the lead-screw actuator. The lead-screw shaft extends through a thrust bearing fitted near the upper end of the crutch leg. The telescoping tubular parts substantially overlap each other, even when moved to maximum extension, and the lowermost of these parts has a pivot joint which extends along an axis generally transverse to the plane containing the arm pit pad of the upper end of the crutch. In other words, such pivot joint is located cross-wise to the plane in which the crutch is swung during use in walking. The crutch handle is in or closely adjacent such plane.

A fore-aft extending foot member is attached to the pivot pin. Such foot member includes a central bar or strut having at least primary and secondary foot pads projecting downward therefrom in fore-aft spaced relation, so as to provide an extended ground or floor contacting area for improved stability and balance. A second linear actuator, e.g. a lead-screw mechanism, is connected between the strut and a pivot joint on the lower portion of the crutch leg. This mechanism is driven to extend and/or retract by a second reversible electric motor, thus controlling the second motor will establish the angular relationship between the foot and the crutch leg. Once this relationship is determined by user control, since the lead screw actuators are essentially self-locking due to their high gear ratio, the actuator maintains the angle until further adjustment. Power for this second motor is carried by extensible connectors within the telescoping rod, thus protecting the electrical supply from dirt, moisture, etc. A modified form of foot structure is provided which has enhanced ground or floor engaging stance, to allow added stability in the rising/sitting motions where such may be desirable.

Thus, in rising from a seat, or during seating, the foot pads establish a floor or ground contact plane, the user determines the angle of the crutch leg to such plane which best fits the user's sense of balance, and that angle remains fixed until further adjustment is desired. Once the is erect and ready to walk, the secondary foot pads can be retracted upward, using the foot adjusting second motor, so the crutch will then utilize the primary foot pad, as in use of a simple crutch.

Each crutch is power independent, including a rechargeable battery pack, a small electric charger, the two reversible DC motors, and the reversing power circuits for each motor using three-position, center biased to off, control switches which are conveniently located in the crutch handle area where these switches can be manipulated with a thumb or finger tip, without significantly affecting the person's grip on the handles.

The primary object of the invention, therefore, is to provide a novel form of crutch which can be used, particularly by paraplegics, to move between sitting and standing positions; to provide such a crutch which includes a unique foot mechanism which gives added stability to the user of a pair of the crutches during such sitting/standing transitions, and which can be retracted so as to avoid interference with normal crutch-aided walking; to provide a set of powered crutches, incorporating both power extension/retraction and power foot adjustment, and which are capable of extended powered operation with on-board electrical power, and which also use power only for adjustment and are self-locking into adjusted positions; to provide such power assisted crutches which are controllable from switches strategically located by the crutch handles so the user can manipulate the control switches without releasing his/her hold on the crutch handles; and to provide such power adjustable crutches which can be customized to the size, weight, and other characteristics of a particular user.

BRIEF DESCRIPTION OF THE DRAWINGS

FIG. 2B is an exploded view of the mechanism internal of the main strut ar the lower portion of FIG. 2A;

FIG. 2C is an exploded view of the mounting for the crutch foot to the main strut;

FIG. 3 is an enlarged detail view of a part of the inner leg strut, showing electrical conductors thereon;

FIG. 4 is a view of a suitable power source connected to the charger receptacle on one of the crutches;

DESCRIPTION OF THE PREFERRED EMBODIMENT

Figure 1:
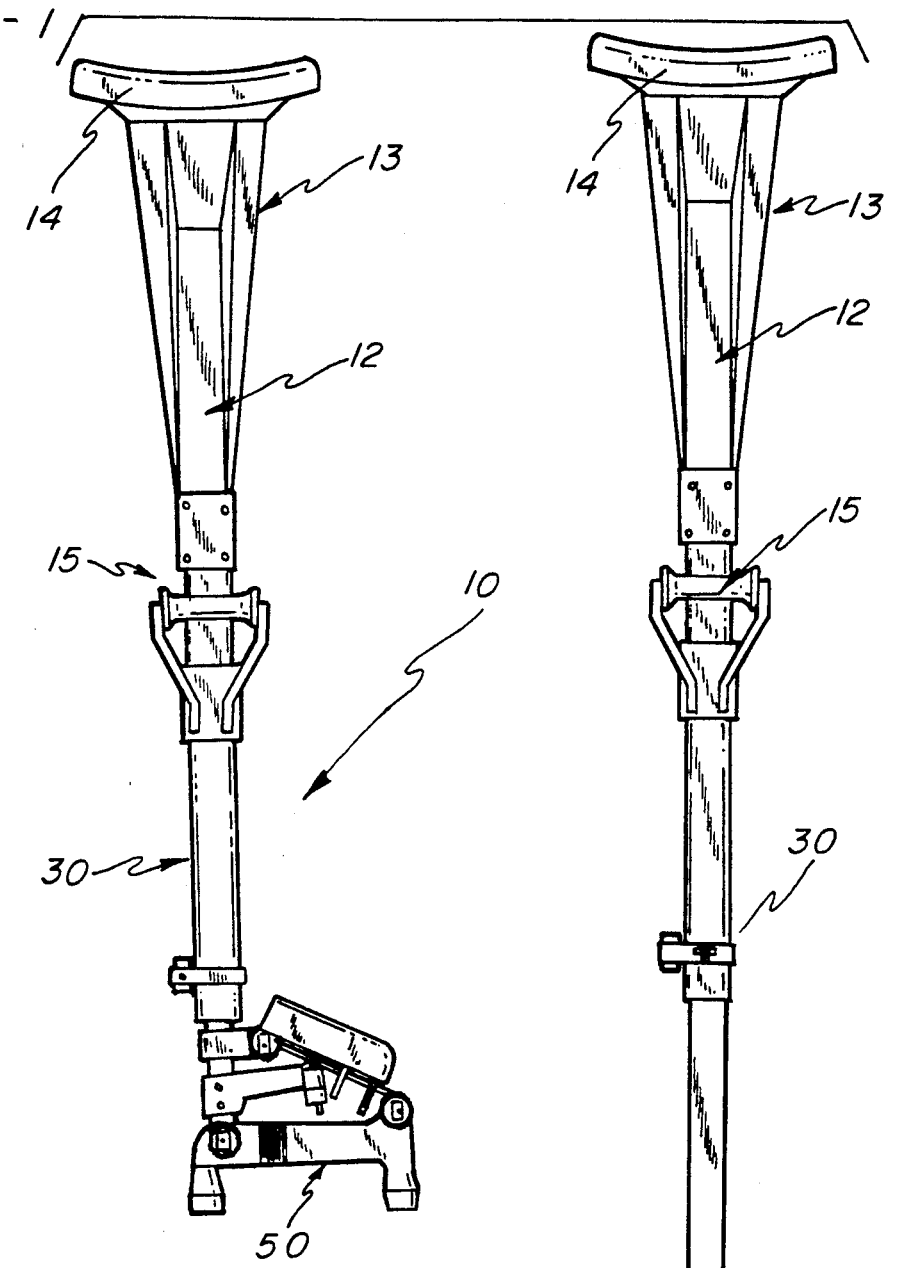
FIG. 1 is a side view of a pair of the crutches, with one fully lengthened and one fully shortened to illustrate the range of length or height adjustment.
Figure 2A:
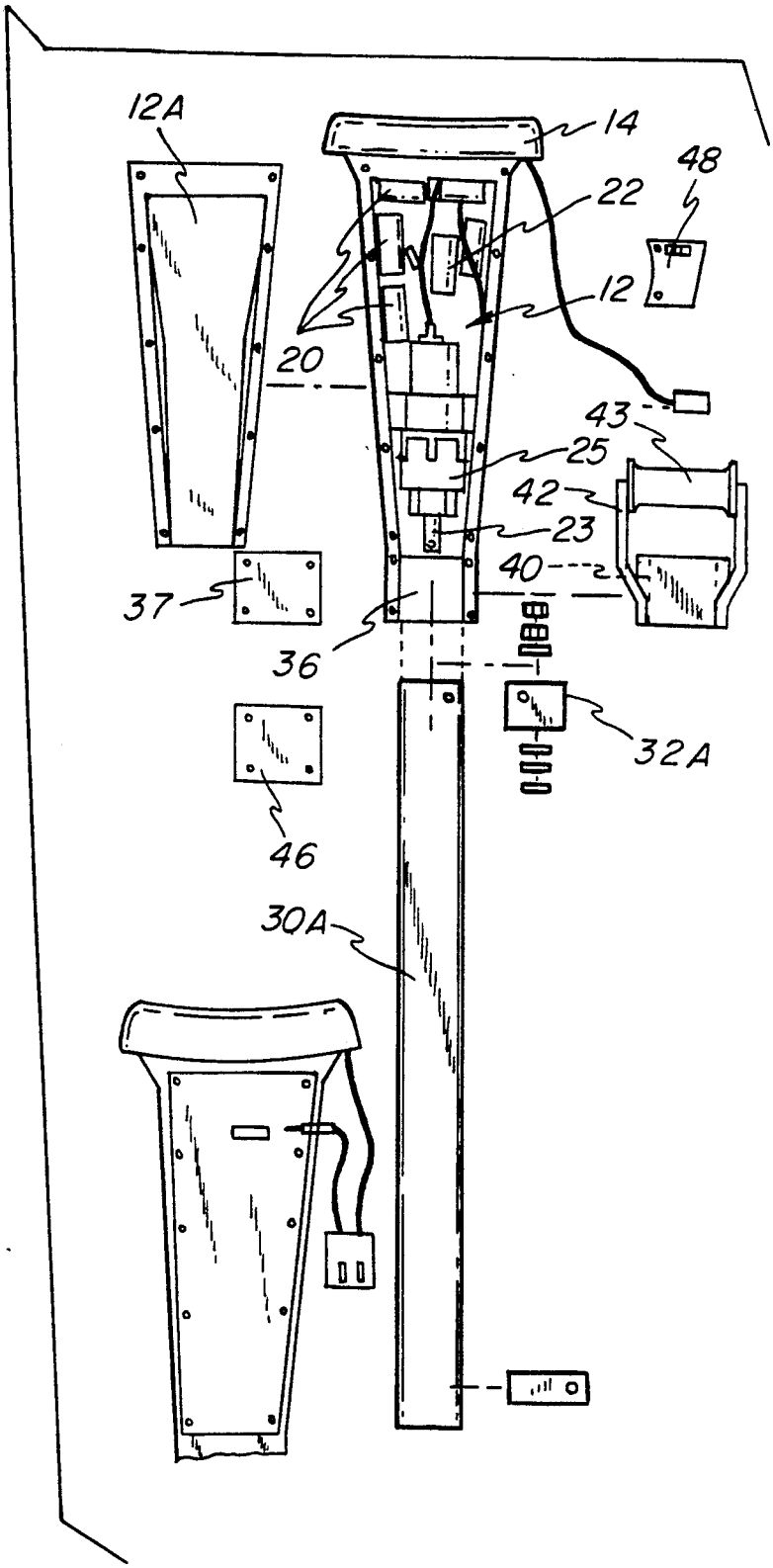
FIG. 2A is an exploded schematic view of the upper portion of one crutch, illustrating particularly the power source and the drive and associated mechanism for changing the length from arm pit pad to the foot device at the lower tip.
Figure 2D:
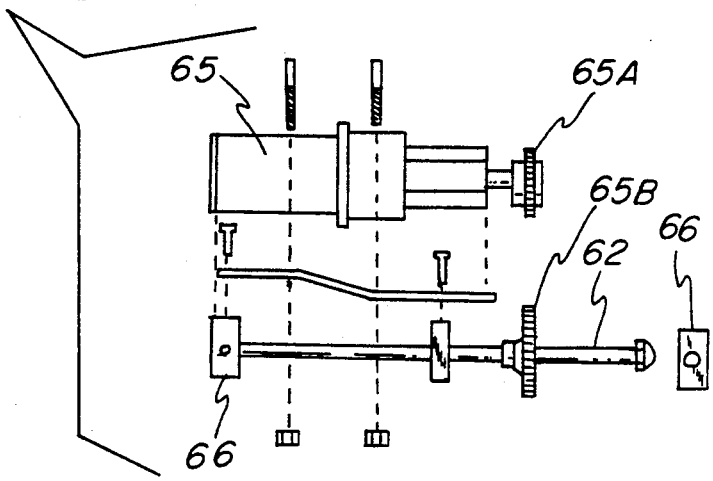
FIG. 2D is an exploded view of the foot adjusting motor and mechanism.
Figure 2E:
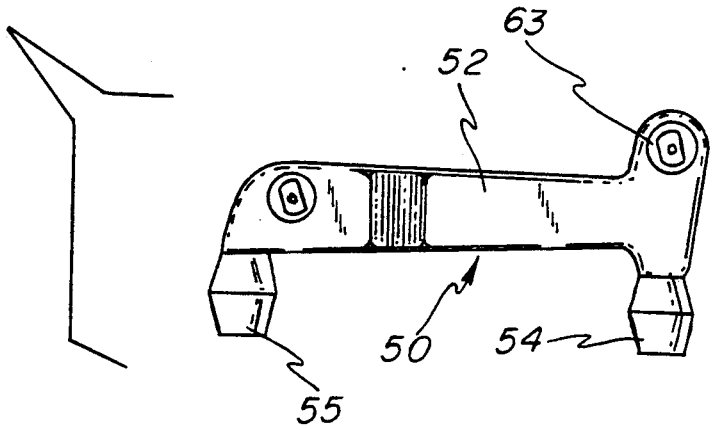
FIG. 2E is a side view of the crutch foot itself.

Referring to FIG. 1, a pair of the unique crutches 10 as provided by the invention each include a covered pocket or chamber 12, with a removable cover 12A, formed in upper body 13 located in the region between the arm pit pad 14 and an adjustable handle 15. One crutch is shown vertically elongated, the other vertically shortened, so the range of this motion (in each crutch) can be seen. As seen in FIG. 2, chamber 12 is typically a vertically elongated generally V-shape having receptacle space for the batteries 20 (C size rechargeable cells have been used), and a small electrical charger 22. The upper end of a length extending/retracting lead-screw actuator 24 extends into chamber 12 and is connected by a coupling 23 to a small reversible DC motor 25. A collar 24A is fastened to actuator 24 near its upper end, and another collar 24B is fastened to the lower end of actuator 24.

The main threaded shaft portion 28 of lead-screw actuator 24 projects into the lower leg portion 30 of the crutch through a thrust bearing 32. The crutch leg or main strut 30 comprises telescoping tubular parts 30A and 30B (preferably square tubes) which substantially overlap each other, even when moved to maximum extension, so as to be capable of resisting side and bending loads while remaining linear and free for relative movement with respect to each other.

The thrust bearing 32 is fixed to the upper end of tube 30A, which in turn is fastened to the lower end of upper body 13, as later described. Typically, the thrust bearing is housed in a square fitting 32A which is pinned into the upper end of tube 30A. At the upper end of lower tube 30B there is fastened a nut member 33 which receives the threads of the main threaded shaft portion 28. Thus, rotation of the lead screw will move the lower tube 30B within (up and down) the outer tube 30A as the motor 25 is appropriately rotated. The type and size of the thread on portion 28, and of the corresponding nut member 33, will be determined by the weight load and the desired speed of raising/lowering movement of the crutch. A cylindrical spacer 34 is carried on and free rotatable around the threaded portion 28 of the actuator 24. The length of this spacer determined the maximum extension of the telescoping leg tubes, because the spacer will abut the lower collar 24B and the bottom of nut member 33 at the designed maximum travel; of the lead-screw in nut 33. In the other direction of travel, upper collar 24A will abut the top of the thrust bearing housing 32A at the retracted design limit.

The lowermost end of tube 30B has a fitting therein which includes a pivot joint 35 extending along an axis 35A generally transverse to a plane P1 containing the arm pit pad 12 at the upper end of the crutch. In other words, such pivot joint 35 is located cross-wise to the plane P1 in which the crutch oscillates or swings, under user control, during use in walking.

As can be seen in FIG. 2, the upper end of leg tube 30A is fitted into a surrounding cavity 36 at the rectangular bottom 13A of upper body 13. A separate cover plate 37 is secured over this joint and fastened to upper body 13 across the open side of cavity 36, thereby clamping the upper body to the top of outer leg tube 30A. The vertical extent of cavity 36 can be designed to provide more or less vertical adjustment in the clamped connection between the upper end of leg tube 30A and the bottom part 13A of body 13

Handle 15 includes a casting (or the like) 40 having a pair of arms 42 extending upward and outward, supporting between them a shaped cylindrical grip 43. The casting 40 has a vertically extending wide slot 45 at its lower face, extending approximately perpendicular to grip 43, and dimensioned to fit snugly about upper leg tube 30A. A clamp plate 46 extends across this slot when the handle is fitted to leg tube 30A, and is joined by suitable bolts or screws to casting 40. Thus, the entire handle assembly 15 can be adjusted along the upper leg tube 30A to provide a custom fit to the arm length of the user, and then clamped securely about the leg. At the forward-facing side of handle 15, there is a switch housing 48 which is mounted to the appropriate one of arms 42, whereby the actuators of control switches (later described) can be presented to the thumb or finger tip of a hand engaged with grip 43.

A fore-aft extending foot member 50 is attached to pivot joint 35, at the lower end of inner leg tube 30B. Such foot member includes a central bar or strut 52 having fore and aft foot pads 54, 55, respectively, projecting downward therefrom in fore-aft spaced relation, so as to provide an extended ground or floor contacting area for improved stability and balance. In the arrangement shown, the front pads 54 are the secondary pads, and the rear pads 55 are the primary pads.

Figures 5, 6:
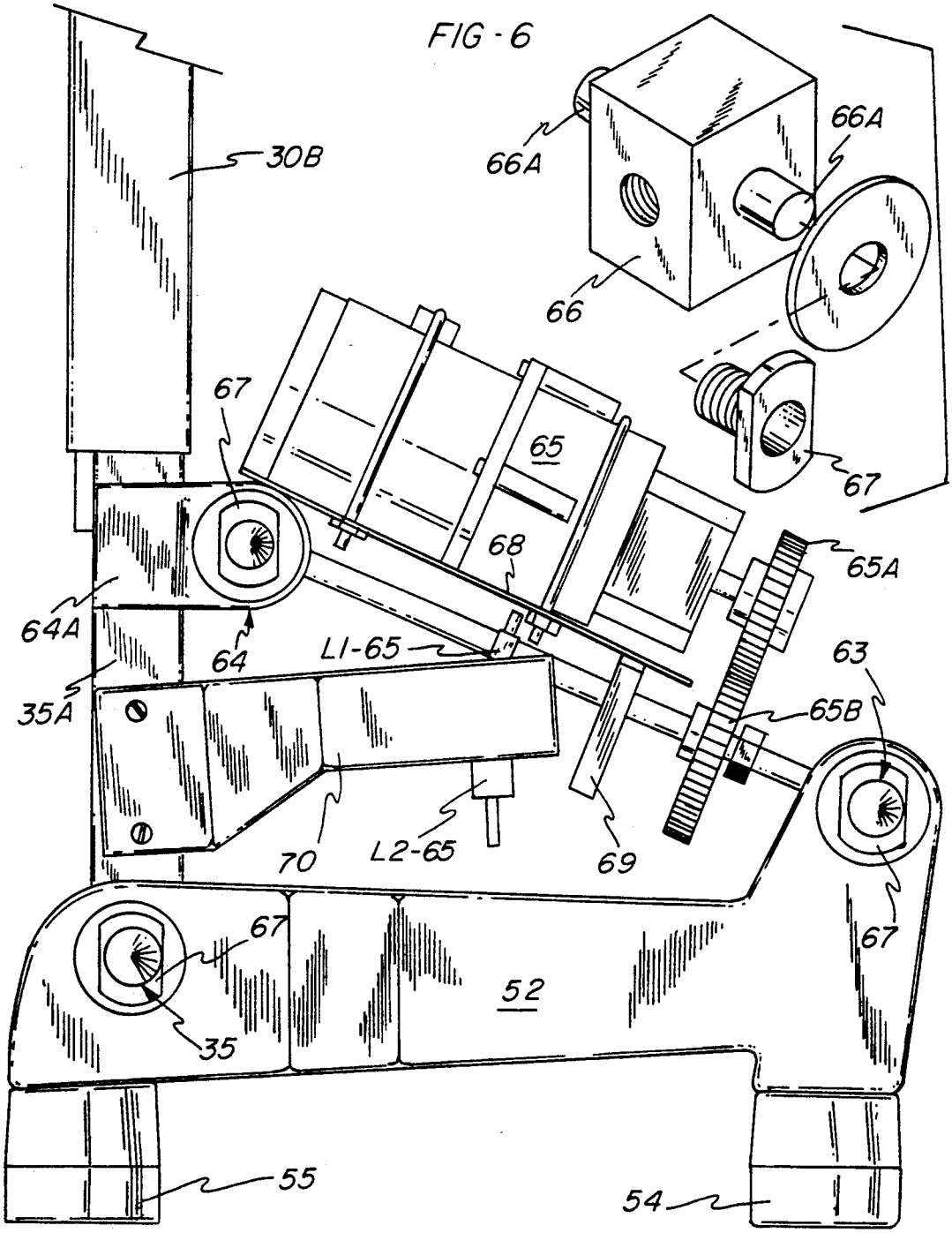
FIG. 5 is an enlarged detail view of the foot mechanism.
FIG. 6 is a schematic perspective view of one of the pivot joints used in the foot mechanism.

A second linear actuator 60, e.g. a power driven reversible lead-screw mechanism 62, is connected between a pivot joint 63 on the outer end of strut 52 and a pivot joint 64 carried by a small arm 64A on the lower tube 30B of the crutch leg (see FIG. 3 for detail). Specifically, one end of a lead-screw shaft 62 is pivotally coupled to pivot joint 64, so as to provide a thrust point, and the other threaded end of shaft 63 is received in an internal nut member 66 which is part of pivot joint 63. Both joints 63 and 64 include pivot blocks 66 (FIG. 6) having integral outward extending stub shafts 66A. These stub shafts are supported within tubular fittings 67 threaded into the side of the foot and into the support arm. for joint 64.

This mechanism is driven to extend and/or retract by a second reversible electric motor 65 through appropriate meshing gears 65A, 65B attached respectively to the drive shaft of motor 65 and the actuator lead-screw 62. the motor is fastened by U-bolts to a carrier plate 68, which in turn is bolted to the block of joint 64 and to a stabilizing bearing block 69 which surrounds lead-screw 62. A further arm 70 extends from lower leg tube 30B, providing a mounting for limit switches (see below) which limit the range of motion of mechanism 60.

The inner leg tube 30B has an insulating strip 72 (as of Nylon) extending the length of one of its sides (see FIG. 3) and a separated pair of brass conductor strips 73 which provide the electrical circuit connection to foot mechanism actuator motor 65. Details of the electrical brushes, etc. cooperating with strips 73, are omitted since these are of conventional construction Thus, actuating the second motor 65 to lengthen and shorten its lead-screw mechanism 60 will establish the angular relationship between the foot member 50 and the crutch leg 30. Once this relationship is determined by user control, the actuator 60 maintains the angle until further adjustment.

Figure 11:
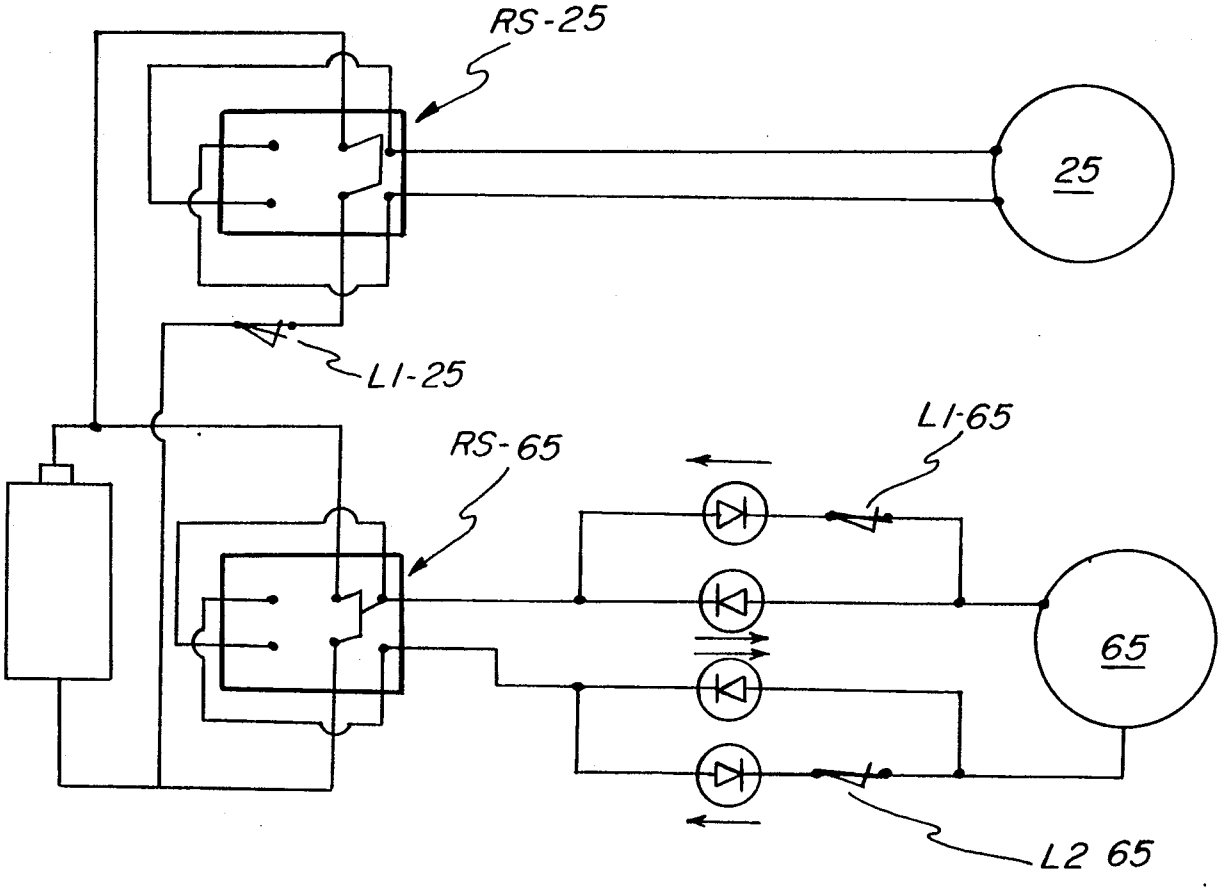
FIG. 11 is a schematic electrical control diagram.

The wiring diagram (FIG. 11) shows the motors 25 and 65 each separately controlled by a manually operated reversing switch RS-25 and RS-65. The battery power source 20 is connected to the common contacts of the reversing switches. Diodes are connected, as shown, to accommodate reversal of current flow from the DC battery source through motor 65. A separate manually actuated normally open power switch L1-25 provides control over power supply to motor 25, depending on the position of reveresing switch RS-25. The collars 24A and 24B, and spacer 34, prevent over-run of motor 25 past the limit of relative motion of the leg tubes 30A, 30B. Limit switches L1-65 and L2-65 prevent over-run of motor 65 past the range of the lead-screw mechanism 62. Obviously, the diode and limit switch type of control can also be used for motor 25.

Switches RS-25 and RS-55 are preferably of the type which are spring-loaded to desired off positions, requiring deliberate manipulation by the user, and may have a bat-type handle which can be easily manipulated in opposite directions to run the motors in the desired directions. These switches are mounted in the housing 48, and the user can keep his hand on the grip 43 while operating the switches with a fingertip.

Figure 12:
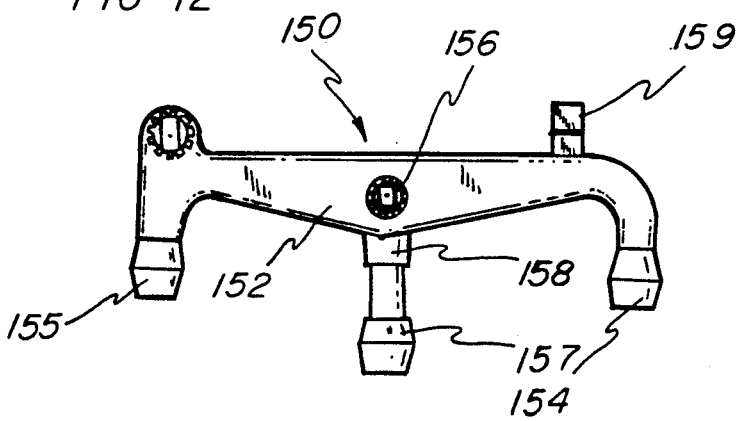
FIG. 12 illustrates an optional form of foot unit for the crutches.

FIG. 12 shows an alternate form of foot device 150 which is intended for situations where the crutches are used more for rising and sitting than for walking. The strut 152 is of greater length (compare with FIG. 1) and has feet 154 and 155 which are wider apart for added stability, the front and rear feet being about eui-distant from a central pivot connection 156 to the bottom end of the lower leg tube. There is also a third removable foot 157 which can be threaded in to a bottom-opening central socket 158 in strut 152, located approximately below pivot connection 156. A suitable clip 159 can be provided on a part of strut 152 to hold third foot 156 when it is not in use.

To use the crutches of the invention for rising from a seated to a standing position, the user makes sure the body brace is locked in the extended position, legs extending straight forward, and then slides forward on the seat to its edge. The crutches are driven to near their minimum length extension, and placed under the user's armpits. The legs of the crutch will extend somewhat outward to opposite sides of the user, and the person's legs will extend forward and downward, with heels touching the ground; see FIG. 5.

Figure 7:
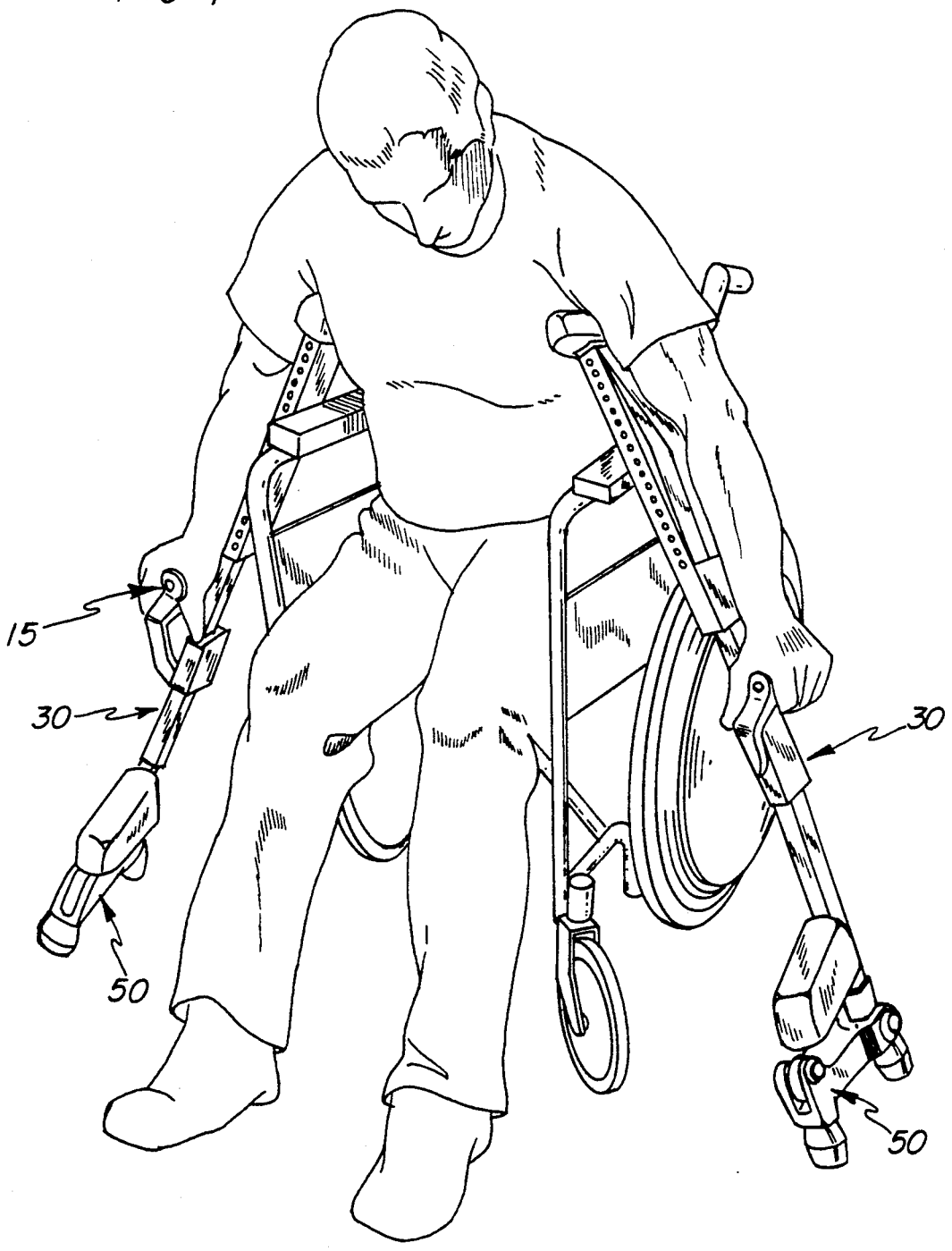
FIGS. 7, 8 and 9 are progressive schematic views illustrating use of the crutches to rise from seated to standing position.

Once the person is comfortable, he sets the reversible control switches RS-25 to the "up direction, and operates the lift power switches L1-25 to cause each leg extension actuator to start to lengthen the crutch legs. As the crutch upper pads lift under the person's arm pits, the person's legs will be drawn inward beneath his/her torso (FIG. 6), and as the crutches near full extension (depending on the person's leg length and height) the braced legs will become erect beneath the torso and the body brace will become more effective in assisting support of body weight (FIG. 7).

Figure 8:
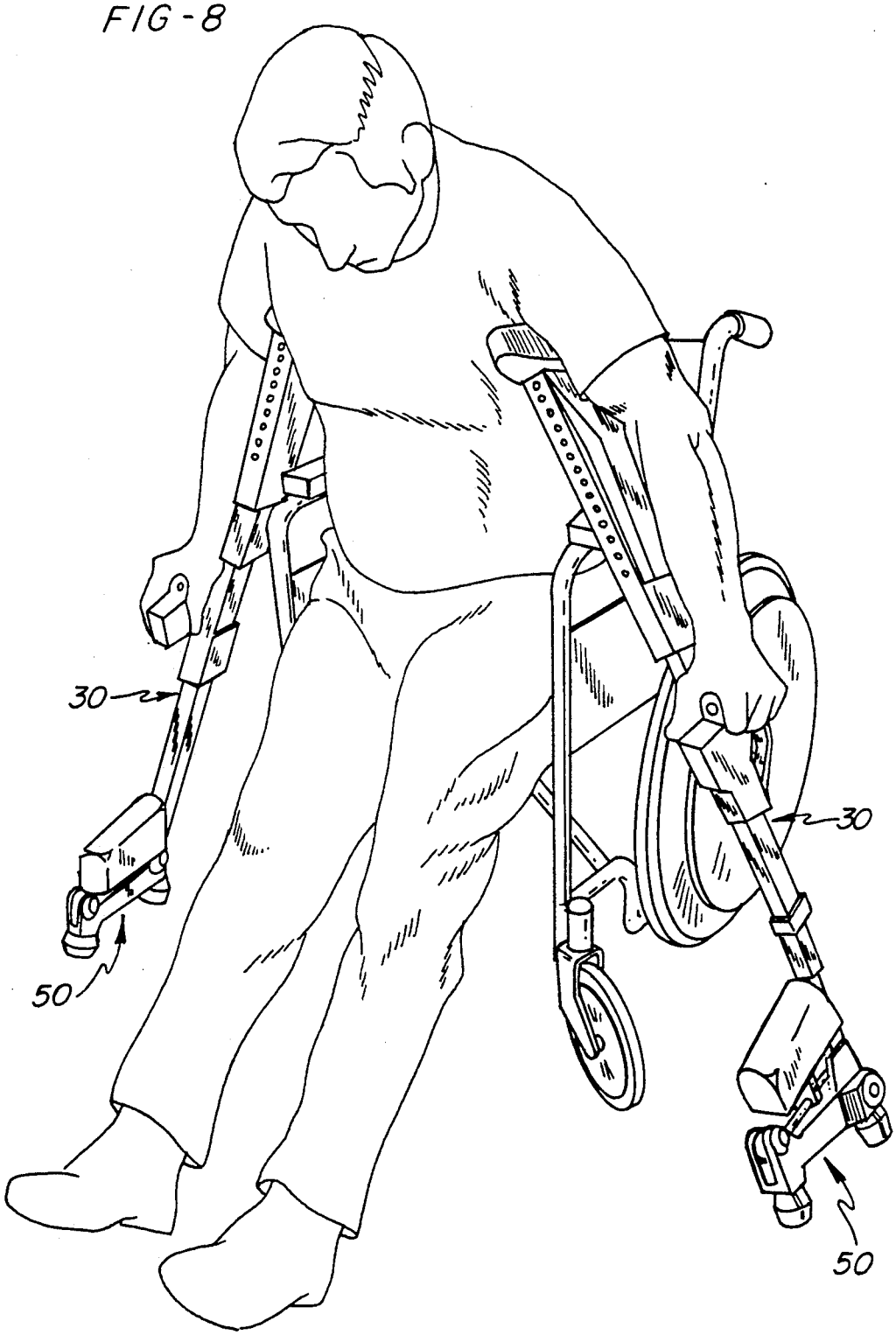
Figure 9:
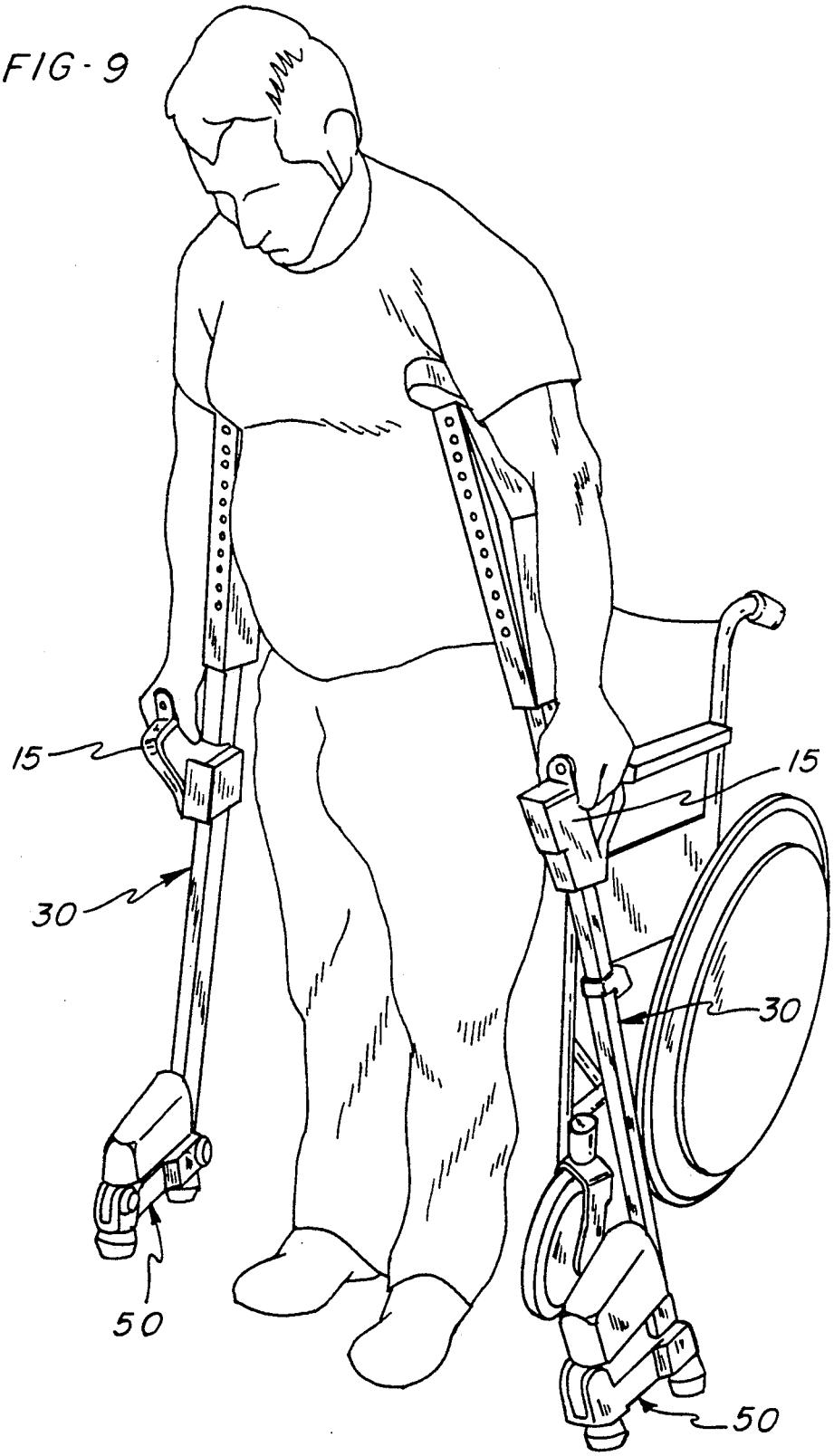
Figure 10:
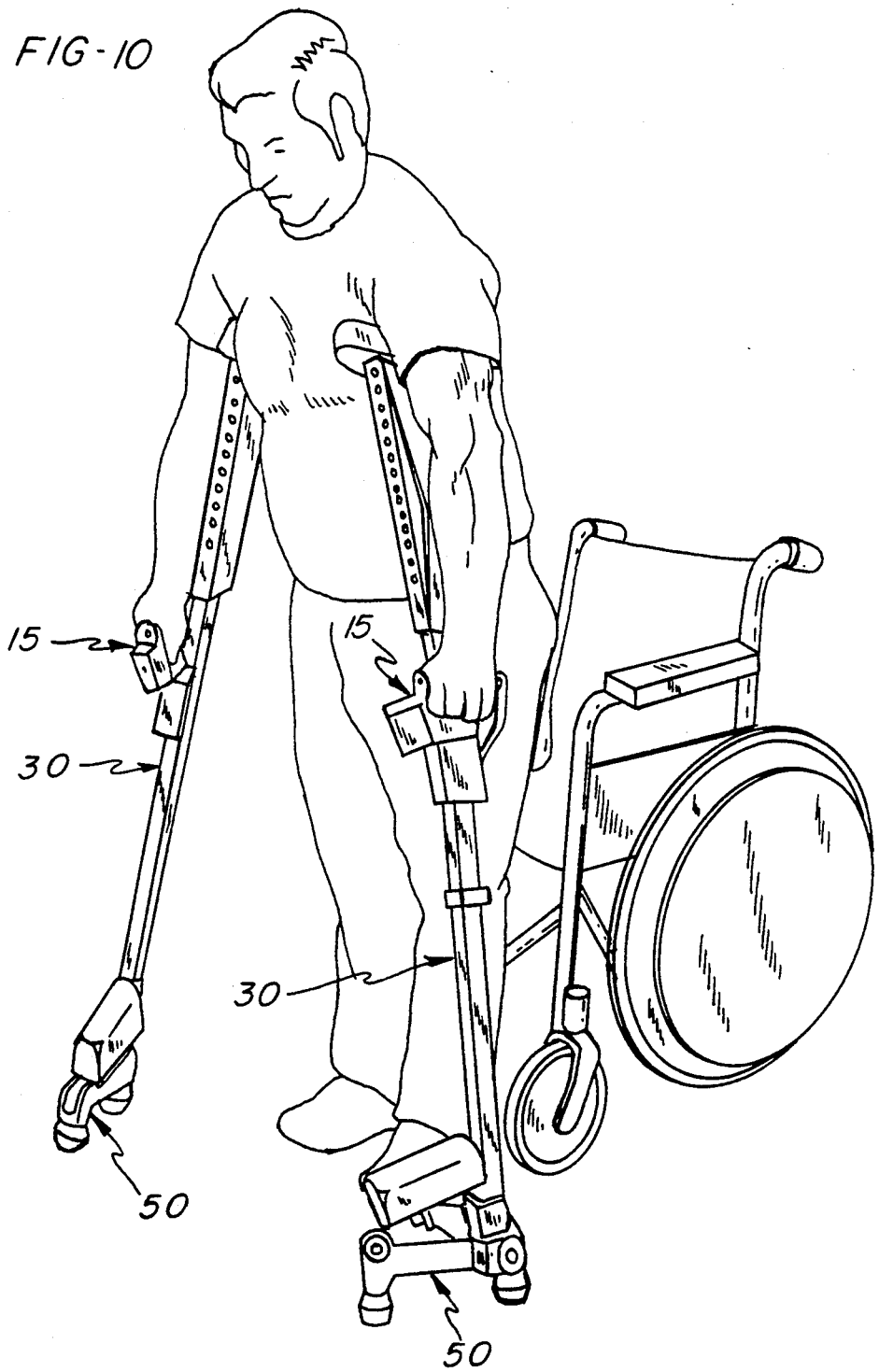
FIG. 10 is a similar schematic view showing the beginning of a walking sequence.

The crutch feet, placed at a desired angle by user actuation of their control motors, will assist in establishing fore-aft balance and the person will achieve a three point stance with his/her feet close together on the ground or floor, and the crutch feet spaced both laterally and aft from the person's feet (see FIG. 8).

Once the person has achieved the standing position, the hips joints of the body brace are locked. It is then possible to adjust the angularity of the crutch feet to whatever feels best for the person in walking. In most cases, this will be to retract (raise) the secondary or fore foot pad 44, leaving the primary foot pad 45 as the single ground engaging pad as with ordinary crutches. Walking is performed in the conventional manner, as is presently done with ordinary crutches, by swinging the lower torso forward through the supportive plane defined by the crutches, then swinging the crutches forward to a new location, etc.

During this function, using the power crutches of the present invention, it is possible to adjust their length, and thus the height of the supportive arm pit pads, to a most comfortable position. It is also possible to adjust the angularity of each crutch's foot, for example effectively to withdraw or lift the secondary or front pad of the foot so it does not ordinarily contact the ground during the walking sequence.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. A power operated crutch for use in assisting in transition between seated and standing positions, comprising an upper crutch body having an arm pit pad at an upper end and a handle adjacent an opposite lower end of said body, said body and said handle being arranged to one side of and fore-aft of a person using the crutch, a telescoping two-piece leg extending downward from said upper body, an actuator connected to said leg to extend and retract the same, means connected to said actuator to power said actuator for causing extending and retracting motion of said telescoping leg; the improvement comprising a foot member including a strut pivotally connected to said leg at the lower end thereof opposite from said upper body, said strut extending generally fore-aft with respect to said body and having at least two foot pads depending therefrom and spaced apart in the fore-aft direction, power operated means connected between said strut and said leg to control and adjust the angle of said strut with respect to said leg.

2. A power actuated crutch as defined in claim 1, wherein said actuator includes a first reversible electrical motor housed in said upper crutch body, a lead-screw mechanism connected for rotation by said first motor and mounted extending within said two-piece leg to move said leg in extension and retraction motion, a second lead-screw mechanism incorporated in said power operated means between said strut and said leg, a second reversible electrical motor operatively connected to said second lead-screw mechanism, a power source housed in said upper body, a control circuit connected to said motors and to said power source, and including manually actuatable switches positioned adjacent said handle whereby a user can manipulate said switches to extend and retract said leg and to alter the angular position of said strut with respect to said leg.

3. A power operated crutch as defined in claim 2, said handle including and adjustable connection to said crutch whereby said handle may be moved lengthwise of said leg to accommodate the arm length of a user.

4. A power operated crutch for use in assisting in transition between seated and standing positions, comprising an upper crutch body having an upper end adapted to extend fore-aft of a person using the crutch, and a handle adjacent an opposite lower end of said body, said body and said handle being arranged to one side of and fore-aft of a person using the crutch, a telescoping two-piece leg extending downward from said upper body, said handle having and adjustable connection to said leg whereby said handle can be vertically adjusted lengthwise of said leg, said leg including inner and outer tubes lengthwise movable with respect to each other providing upper and lower parts of said leg, a first lead-screw actuator connected between said inner and outer leg tubes to extend and retract the same, a power source housed in said upper body, a first reversible electrical motor housed in said upper body and connected to said first actuator and to said power source to power said first actuator for causing extending and retracting motion of said telescoping leg, a foot member including a strut pivotally connected to the lower leg part at the lower end thereof opposite from said upper body, said strut extending generally in the fore-aft of said upper body and having at least two foot pads depending therefrom and spaced apart in the fore-aft direction, and power operated means connected between said strut and said lowermost leg part to control and adjust the angle of said strut with respect to said leg.

5. A power actuated crutch as defined in claim 4, wherein said power operated means includes a second lead-screw mechanism connected between said strut and said leg, a second reversible electrical motor operatively connected to said second lead-screw mechanism, a control circuit connected to said motors and to said power source, and manually actuatable switches positioned adjacent said handle and connected to control respectively and separately said first and second motors, whereby a user can manipulate said switches to extend and retract said leg and to alter the angular position of said strut with respect to said leg.

6. A method of assisting a person having lower torso disability in transition between seated and standing positions, comprising the steps of providing a pair of power operated crutches, each crutch having self-contained power actuators to extend/retract the height of the crutches under user control, each crutch also having an angularly adjustable foot pivoted to the lower end thereof and power actuators for determining the angular relationship of the foot to the leg of the crutch, each crutch including user manipulatable controls for each of the actuators, placing the crutches beneath the arm pits of the user and raising or lowering the user through support of the user's upper torso, controlling the angular position of the crutch feet to establish a stable fore-aft position for the user while undergoing transition between seated and standing positions.

* * * * *